US011676569B2

(12) United States Patent
Miyahara et al.

(10) Patent No.: US 11,676,569 B2
(45) Date of Patent: Jun. 13, 2023

(54) SOUND PRODUCTION DEVICE, SOUND-PRODUCTION-DEVICE EQUIPPED VEHICLE, AND SOUND PRODUCTION METHOD

(71) Applicant: TOYOTA JIDOSHA KABUSHIKI KAISHA, Toyota (JP)

(72) Inventors: Yu Miyahara, Susono (JP); Yuta Tsukada, Sunto-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/652,745

(22) Filed: Feb. 28, 2022

(65) Prior Publication Data

US 2022/0284880 A1 Sep. 8, 2022

(30) Foreign Application Priority Data

Mar. 2, 2021 (JP) ..... JP2021-032698

(51) Int. Cl.
*G10K 11/16* (2006.01)
*G10K 11/178* (2006.01)
*G07C 5/08* (2006.01)

(52) U.S. Cl.
CPC ..... *G10K 11/17881* (2018.01); *G07C 5/0833* (2013.01); *G10K 11/17883* (2018.01)

(58) Field of Classification Search
CPC ..... G10K 11/17881; G10K 11/17883; G07C 5/0833
See application file for complete search history.

(56) References Cited

U.S. PATENT DOCUMENTS 7,088,829 B1 * 8/2006 Schick ..... B60R 99/00 381/86

FOREIGN PATENT DOCUMENTS

JP 2005343401 A 12/2005

* cited by examiner

*Primary Examiner* — Ammar T Hamid
(74) *Attorney, Agent, or Firm* — Hunton Andrews Kurth LLP

(57) ABSTRACT

A sound production device includes memories, processors, a rotation speed correlation value acquisition device configured to acquire a rotation speed correlation value of a rotating body, and a speaker. A noise order sound has a characteristic in which a sound pressure of the noise order sound reaches a maximum sound pressure in a first range of the rotation speed correlation value, and the sound pressure becomes smaller than the maximum sound pressure in second ranges adjacent to both sides the first range. When the rotation speed correlation value falls within the first range, the processors do not output a dummy noise. When the rotation speed correlation value falls within either of the second ranges, the processors output the dummy noise.

7 Claims, 8 Drawing Sheets

| ROTATION SPEED [rpm] | OUTPUT FREQUENCY [Hz] | OUTPUT SOUND PRESSURE [db] |
|---|---|---|
| NEG1 | FQ1 | SP1 |
| NEG2 | FQ2 | SP2 |
| ... | ... | ... |
| NEGn | FQn | SPn |

| ROTATION SPEED [rpm] | REFERENCE FREQUENCY [Hz] | REFERENCE SOUND PRESSURE [db] |
|---|---|---|
| NEG1 | BFQ1 | BSP1 |
| NEG2 | BFQ2 | BSP2 |
| ... | ... | ... |
| NEGn | BFQn | BSPn |

FIG. 12

FORCE: FGn

FORCE: FG2

FORCE: FG1

| ROTATION SPEED [rpm] | OUTPUT FREQUENCY [Hz] | OUTPUT SOUND PRESSURE [db] |
|---|---|---|
| NEG1 | FQ1 | SP1 |
| NEG2 | FQ2 | SP2 |
| ... | ... | ... |
| NEGn | FQn | SPn |

...

SOUND PRODUCTION DEVICE, SOUND-PRODUCTION-DEVICE EQUIPPED VEHICLE, AND SOUND PRODUCTION METHOD

CROSS-REFERENCE TO RELATED APPLICATION

This application claims priority to Japanese Patent Application No. 2021-032698 filed on Mar. 2, 2021, incorporated herein by reference in its entirety.

BACKGROUND

1. Technical Field

This disclosure relates to a sound production device, a sound-production-device equipped vehicle, and a sound production method.

2. Description of Related Art

Japanese Unexamined Patent Application Publication No. 2005-343401 (JP 2005-343401 A) describes a technology for masking a single tone noise such as a gear noise to be generated inside a vehicle cabin. In this technology, when it is determined that a single tone noise such as a gear noise is generated inside a vehicle cabin, a white noise with a critical bandwidth of the single tone noise is produced as a masking tone to mask the single tone noise.

SUMMARY

Noises to be generated inside the vehicle cabin include a noise order sound the frequency of which fluctuates in accordance with the rotation speed of a rotating body. Some noise order sounds may increase in sound pressure only in a specific frequency band. It may be said that the single tone noise described in JP 2005-343401 A is also a kind of such a noise.

A noise the sound pressure of which increases only in a specific state tends to give an uncomfortable feeling to people. With the technology of JP 2005-343401 A, it is possible to cause the single tone noise to be hardly heard by producing a white noise. However, in the technology of JP 2005-343401 A, the white noise is produced in a specific frequency band called the criticality band width of the single tone noise. Accordingly, for an occupant, noises are still generated in the specific frequency band, so that the occupant might still have an uncomfortable feeling.

This disclosure is accomplished in view of the above problem, and an object of this disclosure is to provide a technology that can reduce an uncomfortable feeling to be given to an occupant due to a noise to be generate inside a vehicle.

In order to achieve the above object, a first disclosure is applied to a sound production device for producing a dummy noise including a sound with a frequency corresponding to a noise order sound generated from a rotating body provided in a vehicle. The sound production device includes one or more memories, one or more processors, a rotation speed correlation value acquisition device, and a speaker. In the one or more memories, one or more programs are stored. The one or more processors are connected to the one or more memories. The rotation speed correlation value acquisition device is configured to acquire a rotation speed correlation value of the rotating body. The speaker is configured to output sounds inside a vehicle cabin of the vehicle. When the one or more processors execute the one or more programs, the one or more processors execute a dummy noise output process of outputting the dummy noise from the speaker in accordance with the rotation speed correlation value. The noise order sound has a characteristic in which a sound pressure of the noise order sound reaches a maximum sound pressure in a first range of the rotation speed correlation value, and the sound pressure becomes smaller than the maximum sound pressure in second ranges adjacent to both sides the first range. In the dummy noise output process, when the rotation speed correlation value falls within the first range, the one or more processors do not output the dummy noise, and when the rotation speed correlation value falls within either of the second ranges, the one or more processors output the dummy noise within a range where a sum value of the sound pressure of the noise order sound and an output sound pressure of the dummy noise does not exceed the maximum sound pressure.

A second disclosure further has the following feature in the first disclosure. That is, a dummy noise map defining the output sound pressure of the dummy noise in association with a parameter including the rotation speed correlation value may be stored in the one or more memories. In the dummy noise output process, the one or more processors may be configured to acquire an output sound pressure for the dummy noise that corresponds to the rotation speed correlation value in accordance with the dummy noise map and to output, from the speaker, the dummy noise with the output sound pressure thus acquired.

A third disclosure further has the following feature in the second disclosure. That is, a noise order sound map defining a fluctuation characteristic of the sound pressure of the noise order sound in accordance with fluctuations in the rotation speed correlation value may be stored in the one or more memories. When the one or more processors execute the one or more programs, the one or more processors may be configured to execute a map setting process of setting the output sound pressure for the dummy noise defined in the dummy noise map, based on the noise order sound map. In the map setting process, the one or more processors may acquire a sound pressure of the noise order sound from the noise order sound map and set a sound pressure for the dummy noise in the dummy noise map such that a sum value of the acquired sound pressure of the noise order sound and the output sound pressure of the dummy noise reaches the maximum sound pressure.

A fourth disclosure further has the following feature in the third disclosure. That is, the sound production device may further include a microphone configured to collect sounds inside the vehicle cabin of the vehicle. When the one or more processors execute the one or more programs, the one or more processors may further execute a map correction process of correcting the fluctuation characteristic defined in the noise order sound map based on a measured value of the noise order sound measured by use of the microphone.

A fifth disclosure further has the following feature in any one of the second to fourth disclosures.

That is, the dummy noise map may further include force to be applied to the rotating body as the parameter. In the dummy noise output process, the one or more processors may calculate force to be applied to the rotating body based on operation state information on the vehicle and acquire the output sound pressure for the dummy noise that corresponds to the force to be applied to the rotating body and the rotation speed correlation value, in accordance with the dummy noise map.

A sixth disclosure is applied to a sound-production-device equipped vehicle. The sound-production-device equipped vehicle includes the sound production device disclosed in any one of the first to fifth disclosures.

A seventh disclosure is applied to a sound production method for causing a computer to produce, from a speaker, a dummy noise including a sound with a frequency corresponding to a noise order sound generated from a rotating body included in a vehicle, the dummy noise being produced in accordance with a rotation speed correlation value of the rotating body. The noise order sound has a characteristic in which a sound pressure of the noise order sound reaches a maximum sound pressure in a first range of the rotation speed correlation value, and the sound pressure becomes smaller than the maximum sound pressure in second ranges adjacent to both sides of the first range. The computer acquires the rotation speed correlation value of the rotating body. When the rotation speed correlation value falls within the first range, the computer does not output the dummy noise, and when the rotation speed correlation value falls within either of the second ranges, the computer outputs the dummy noise within a range where a sum value of the sound pressure of the noise order sound and an output sound pressure of the dummy noise does not exceed the maximum sound pressure.

In this disclosure, the dummy noise includes a sound with a frequency corresponding to the noise order sound generated from the rotating body. In the first range of the rotation speed correlation value in which the noise order sound generated from the rotating body reaches the maximum sound pressure, the sound production device does not output the dummy noise, but in either of the second ranges adjacent to both sides of the first range, the sound production device outputs the dummy noise. In such a configuration, a sum value of the sound pressure of the noise order sound and the output sound pressure of the dummy noise is close to the maximum sound pressure in the second ranges. Accordingly, even in a case where the rotation speed correlation value fluctuates, a gear noise order sound can be heard continuously inside the vehicle cabin. Hereby, it is possible to reduce an uncomfortable feeling to be given to an occupant by the gear noise order sound.

In the second disclosure, the output sound pressure of the dummy noise is acquired based on the rotation speed correlation value. The sound pressure of the noise order sound fluctuates in accordance with the rotation speed correlation value. Accordingly, with this disclosure, it is possible to set the output sound pressure of the dummy noise in consideration of the sound pressure of the noise order sound.

In the third disclosure, the sound pressure of the dummy noise can be set such that a sum value of the sound pressure of the noise order sound and the sound pressure of the dummy noise reaches the maximum sound pressure. Hereby, the gear noise order sound with the maximum sound pressure can be heard continuously inside the vehicle cabin, thereby making it possible to reduce the uncomfortable feeling to be given to an occupant by the gear noise order sound.

In the fourth disclosure, the fluctuation characteristic of the noise order sound can be corrected based on the measured value of the noise order sound collected by the microphone. Hereby, even in a case where the fluctuation characteristic of the noise order sound changes due to deterioration over time or the like, it is possible to set the sound pressure of the dummy noise appropriately.

In the fifth disclosure, the sound pressure of the dummy noise is acquired based on the rotation speed correlation value and the force to be applied to the rotating body. The sound pressure of the noise order sound also fluctuates in accordance with the force to be applied to the rotating body. Accordingly, with this disclosure, it is possible to set the output sound pressure of the dummy noise further in consideration of the sound pressure of the noise order sound.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein:

FIG. 12 is a view illustrating an example of a dummy noise map set in consideration of force to be applied to a gear.

DETAILED DESCRIPTION OF EMBODIMENTS

With reference to the drawings, the following describes an embodiment of this disclosure. Note that, when any number such as the number, quantity, amount, or range of each element is referred to in the following embodiment, this disclosure is not limited to the referred number except when the number is particularly explicitly indicated or the element is obviously specified to the number in principle. Moreover, the structure and so on described in the following embodiment are not necessarily indispensable to this disclosure except when they are particularly explicitly indicated or obviously specified in principle.

Embodiment

1. Exemplary Configuration of Sound Production Device

Figure 1:
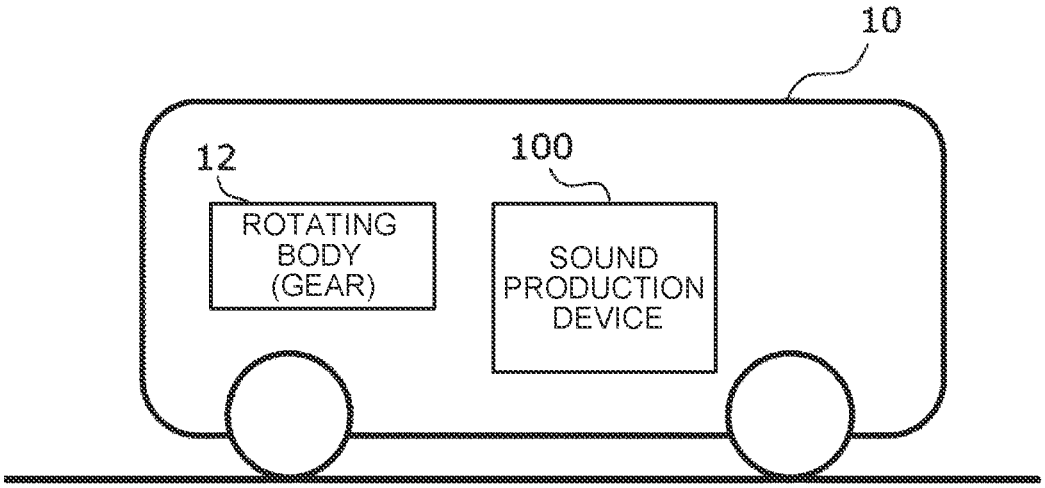
FIG. 1 is a view illustrating an outline structure of a vehicle to which a sound production device according to an embodiment is applied.
Figure 2:
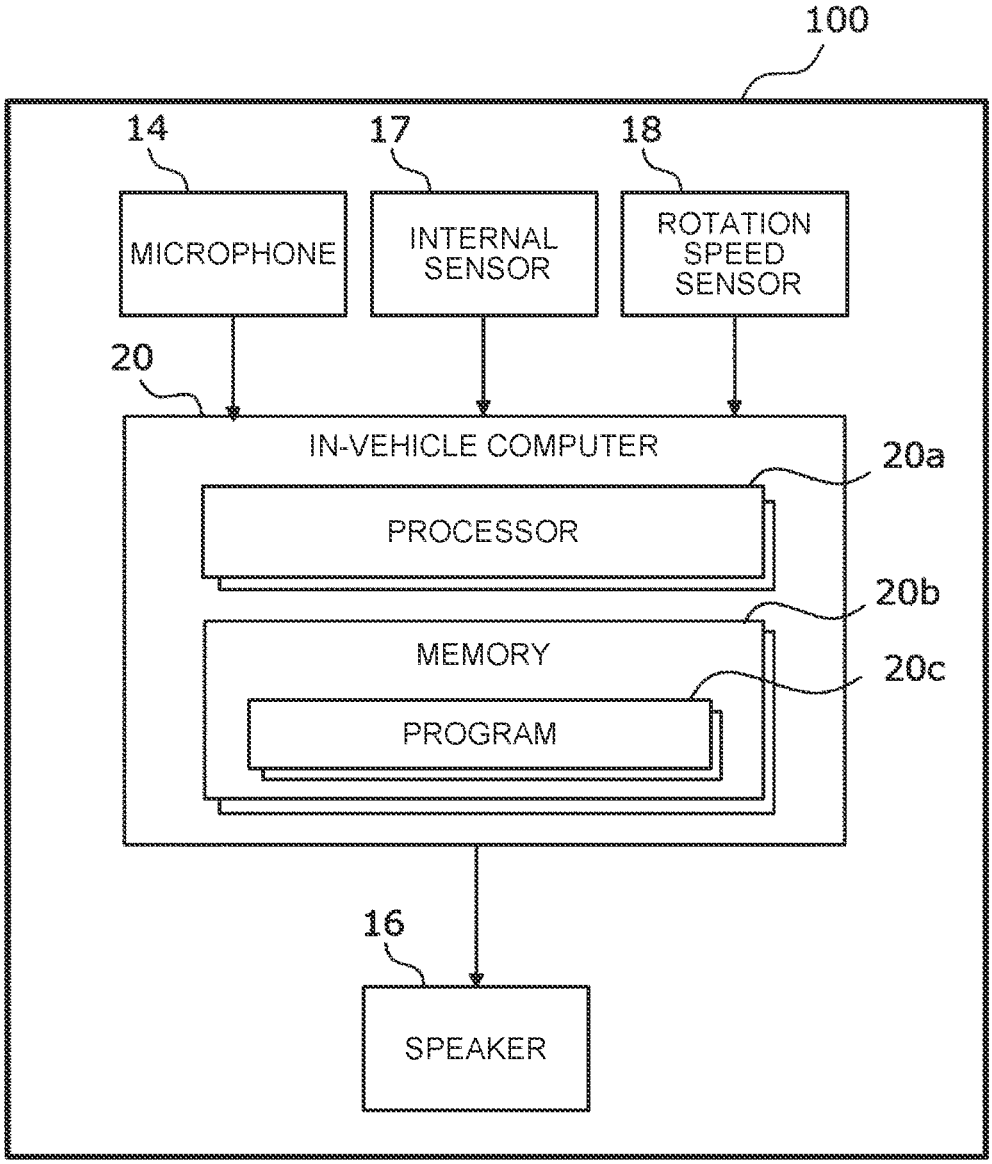
FIG. 2 is a view illustrating an outline structure of the sound production device according to the embodiment.

FIG. 1 is a view illustrating an outline structure of a vehicle to which a sound production device according to an embodiment is applied. FIG. 2 is a view illustrating an outline structure of the sound production device according to the embodiment. A sound production device 100 is provided in a vehicle 10. That is, the vehicle 10 is a sound-production-device equipped vehicle. The vehicle 10 includes a rotating body such as a gear, a motor, or an inverter that performs rotational motion, for example. Noises to be generated from the rotating body include a noise order sound the frequency of which fluctuates in accordance with the rotation speed of the rotating body. The present embodiment deals with a case where the vehicle 10 includes a gear 12 for a driving system as the rotating body, and a noise order sound called a "gear noise order sound" is generated along with the rotational motion of the gear 12.

The sound production device 100 includes an in-vehicle computer 20. The in-vehicle computer 20 is an electronic control unit (ECU) to be provided in the vehicle 10. Further, the sound production device 100 includes a microphone 14, a speaker 16, an internal sensor 17, and a rotation speed sensor 18. These are connected to the in-vehicle computer 20 by use of an in-vehicle network such as a controller area network (CAN).

The in-vehicle computer 20 includes one or more processors 20*a* (just referred to as the processors 20*a*) and one or more memories 20*b* (hereinafter just referred to as the memory 20*b*) connected to the processors 20*a*. In the memories 20*b*, one or more programs 20*c* (just referred to as the programs 20*c*) executable by the processors 20*a* and a various pieces of information relating to the one or more programs 20*c* are stored.

When the processors 20*a* execute the programs 20*c*, various processes by the processors 20*a* are implemented. The programs 20*c* include a program to produce a sound inside a vehicle cabin, for example. The memories 20*b* include a main storage device and an auxiliary storage device. The programs 20*c* can be stored in the main storage device or can be stored in a computer readable recording medium as the auxiliary storage device.

The microphone 14 is a sound collector configured to collect sounds inside the vehicle cabin. The microphone 14 may be placed near a boarding position of an occupant inside the vehicle cabin, for example, so that the microphone 14 can collect sounds as close to sounds that the occupant inside the vehicle cabin hears as possible. A plurality of microphones 14 may be provided. Further, a microphone for other devices such as a navigation system of the vehicle 10 may be also usable as the microphone 14.

The speaker 16 is a sound output device configured to produce sounds inside the vehicle cabin. The arrangement of the speaker 16 in the vehicle cabin is not limited particularly. The speaker 16 may be placed near the boarding position of the occupant inside the vehicle cabin, for example, so that the speaker 16 can output sounds toward the occupant inside the vehicle cabin. Further, a plurality of speakers 16 may be provided. Further, a speaker for a device such as an audio device provided inside the vehicle cabin or the navigation system may be also usable as the speaker 16.

The internal sensor 17 includes a state sensor configured to acquire information on an operating state of the vehicle 10. Examples of the internal sensor 17 include a wheel speed sensor configured to detect a vehicle speed, an acceleration sensor, and so on. Information acquired by the internal sensor 17 is sent to the in-vehicle computer 20. Hereinafter, the information acquired by the internal sensor 17 is referred to as "operation state information."

The rotation speed sensor 18 acquires a rotation speed NEG of the gear 12 that is a rotating body, as a rotation speed correlation value. That is, the rotation speed sensor 18 functions as a rotation speed correlation value acquisition device configured to acquire the rotation speed correlation value of the gear 12 as the rotating body. The rotation speed NEG acquired by the rotation speed sensor 18 is transmitted to the in-vehicle computer 20.

2. Sound Production Method for Sound Production Device in Embodiment

Figure 3:
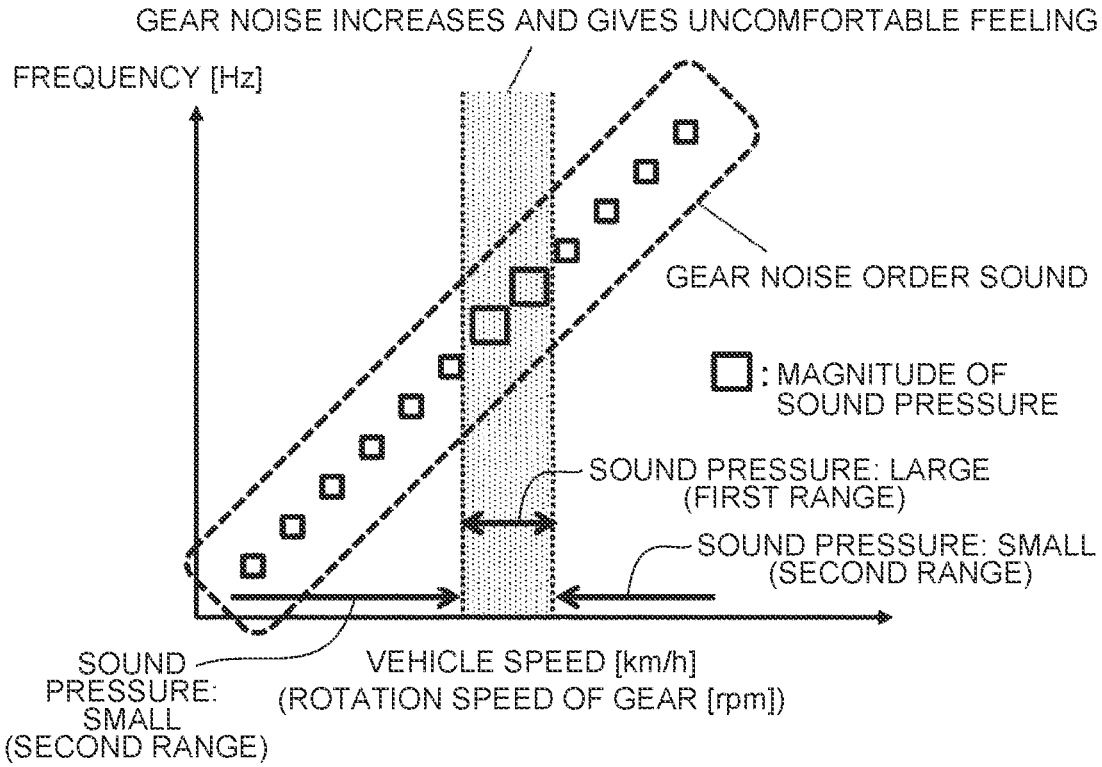
FIG. 3 is a view illustrating an example of the spectrum of a gear noise order sound to be generated in a vehicle cabin.

FIG. 3 is a view illustrating an example of the spectrum of a gear noise order sound to be generated inside the vehicle cabin. The vehicle speed of the vehicle 10 is a rotation speed correlation value correlating with the rotation speed of the gear 12. Accordingly, the frequency characteristic of the gear noise order sound fluctuates in accordance with the vehicle speed and the rotation speed of the gear 12. Here, as illustrated in FIG. 3, the sound pressure of the gear noise order sound may increase at a specific vehicle speed. Generally, it is known that people more sensitively react to a sound that people can hear only in a specific state than a sound that people always hear. Accordingly, as illustrated in FIG. 3, the gear noise order sound the sound pressure of which increases at a specific vehicle speed may give an uncomfortable feeling to an occupant.

Figure 4:
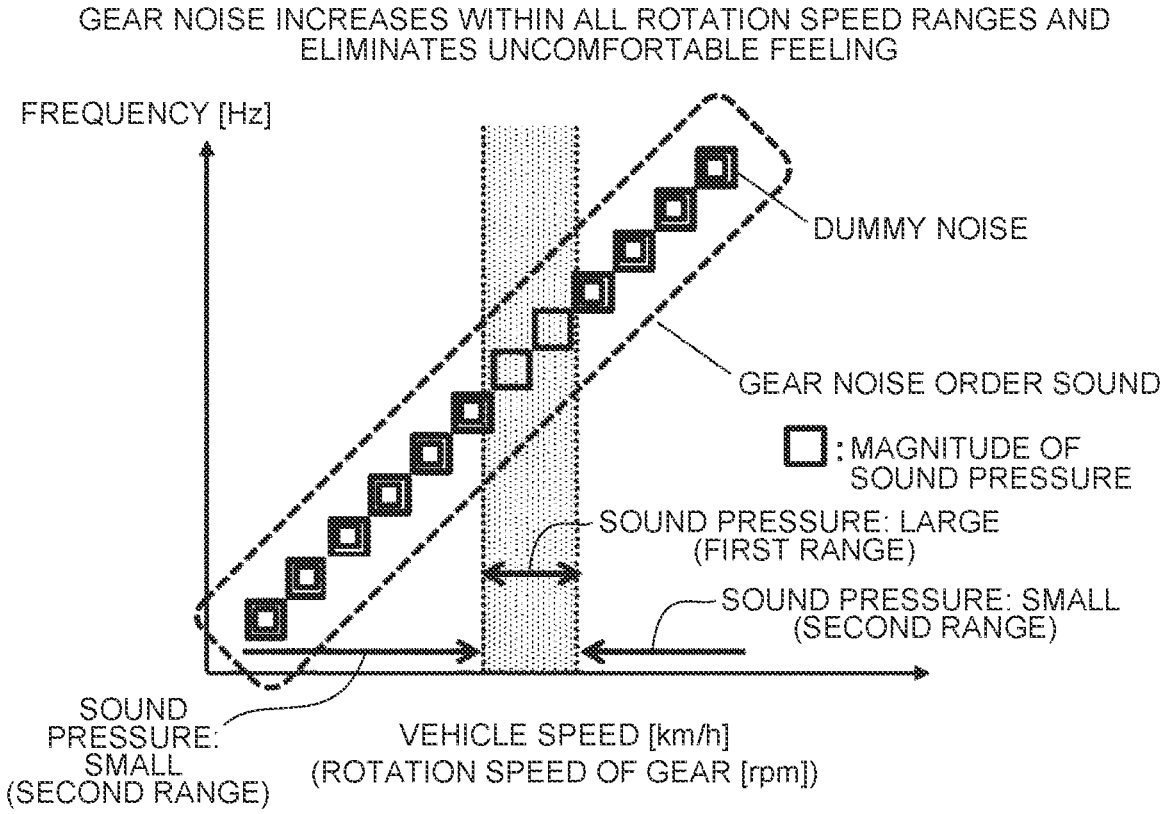
FIG. 4 is a view illustrating an example of the spectrum of the gear noise order sound to be generated in the vehicle cabin and a dummy noise.

In view of this, in the sound production device 100 of the present embodiment, a noise including a sound with a frequency corresponding to the gear noise order sound generated inside the vehicle cabin is output from the speaker 16. This noise is hereinafter referred to as a "dummy noise." FIG. 4 is a view illustrating an example of the spectrum of the gear noise order sound to be generated in the vehicle cabin and the dummy noise. In the example illustrated in FIG. 4, a first range of the rotation speed of the gear 12 includes at least a rotation speed at which the sound pressure of the gear noise order sound reaches a maximum sound pressure. Second ranges are ranges of rotation speeds that is smaller than the minimum value of the first range and that is larger than the maximum value of the first range. The sound pressure of the gear noise order sound in the second ranges is relatively smaller than that in the first range.

Figures 5, 6, 7:
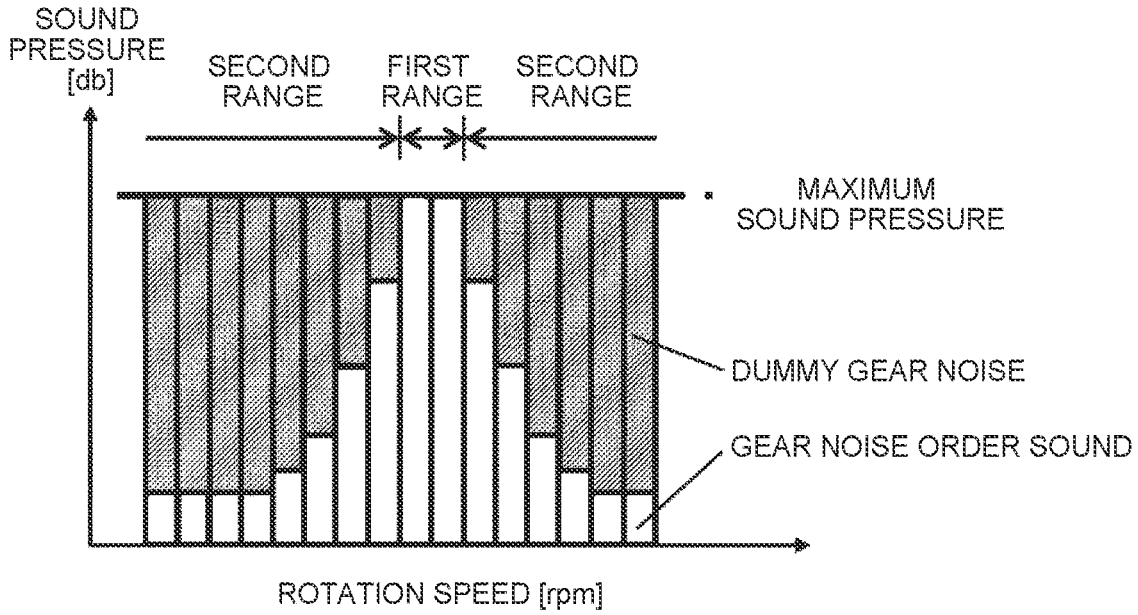
FIG. 5 is a view illustrating an example of a dummy noise map.
FIG. 6 is a view illustrating an example of a noise order sound map.
FIG. 7 is an example illustrating fluctuations in the sound pressure of the gear noise order sound inside the vehicle cabin in a case where the dummy noise is output.

In the sound production device 100 of the present embodiment, the dummy noise is not output from the speaker 16 in the first range, but the dummy noise is output from the speaker 16 in the second ranges. This process is referred to as a "dummy noise output process." Sound characteristics (frequency and sound pressure) of the dummy noise to be output are defined in a dummy noise map, for example. FIG. 5 is a view illustrating an example of the dummy noise map. The dummy noise map defines an output frequency FQ and an output sound pressure SP of the dummy noise in association with the rotation speed NEG of the gear 12 as a parameter. In the dummy noise map, the output frequency FQ of the dummy noise is set to become a frequency corresponding to the frequency characteristic of the gear noise order sound that fluctuates in accordance with the rotation speed NEG.

In the sound production device 100, a noise order sound map that defines fluctuation characteristics of a reference frequency BFQ and a reference sound pressure BSP of the noise order sound that correspond to fluctuations in the rotation speed NEG. FIG. 6 is a view illustrating an example of the noise order sound map. The noise order sound map is obtained by mapping the noise order sound inside the vehicle cabin of the vehicle 10 that fluctuates in accordance with the rotation speed NEG. Values found by experiment or the like can be used for the reference sound pressure BSP and the reference frequency BFQ of the noise order sound map.

In the dummy noise map, the output sound pressure SP of the dummy noise can be set based on the fluctuation characteristics stored in the noise order sound map, for example. This process is referred to as a "map setting process."

Typically, in the map setting process, a relationship between the rotation speed NEG and the reference sound pressure BSP is acquired from the noise order sound map. Then, the output sound pressure SP of the dummy noise that corresponds to the rotation speed NEG is set such that a sum value of the reference sound pressure BSP and the output sound pressure SP of the dummy noise reaches a maximum sound pressure MSP without depending on fluctuations in the rotation speed NEG. Note that a specific process to be executed in the map setting process will be described later in detail.

Note that the fluctuation characteristics of the noise order sound that are defined in the noise order sound map may deviate from actual fluctuation characteristics due to deterioration in the vehicle 10 over time, an environmental condition, or the like. In view of this, the sound production device 100 can correct the fluctuation characteristics defined in the noise order sound map, based on a measured value of the noise order sound inside the vehicle cabin that is collected by the microphone 14, for example. This process is referred to as a "map correction process." Typically, in the map correction process, the sound pressure DSP of the noise order sound that is measured by use of the microphone 14 is compared with the reference sound pressure BSP of the noise order sound that is defined in the noise order sound map. In a case where these sound pressures are different from each other, the reference sound pressure BSP is corrected to a value of the measured sound pressure DSP. A specific process to be executed in the map correction process will be described later in detail.

FIG. 7 is an example illustrating fluctuations in the sound pressure of the gear noise order sound inside the vehicle cabin in a case where the dummy noise is output. In the example illustrated in FIG. 7, no dummy gear noise is output in the first noise in which the gear noise order sound reaches the maximum sound pressure, and the dummy gear noise is output in the second ranges adjacent to both sides of the first range such that a sum value of the output sound pressure SP reaches the maximum sound pressure MSP. Since the dummy noise is produced inside the vehicle cabin by a dummy noise output process as such, even when the rotation speed NEG fluctuates in accordance with a change in the vehicle speed, the gear noise order sound can be heard continuously at a given sound pressure inside the vehicle cabin. This makes it possible to reduce an uncomfortable feeling to be given to an occupant by the gear noise order sound.

3. Functional Configuration of Sound Production Device in Embodiment

Figure 8:
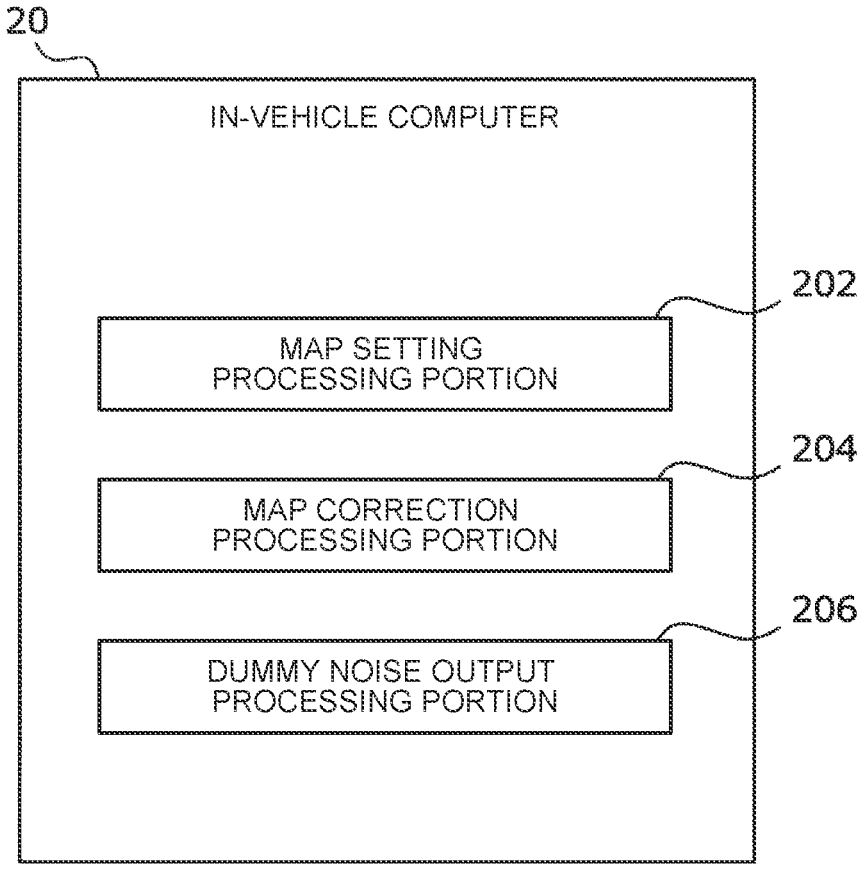
FIG. 8 is a block diagram illustrating functions of an in-vehicle computer.

The above sound production method can be implemented by the sound production device 100 according to the present embodiment that has the configuration illustrated in FIG. 2. In FIG. 8, functions provided in the in-vehicle computer 20 are illustrated in respective blocks. The following describes the sound production device 100 according to the embodiment mainly about the functions of the in-vehicle computer 20. Note that descriptions about the configuration or functions that have been already described are omitted or simplified.

The in-vehicle computer 20 includes a map setting processing portion 202, a map correction processing portion 204, and a dummy noise output processing portion 206. When the programs 20*c* stored in the memories 20*b* of the in-vehicle computer 20 are executed by the processors 20*a*, these portions are implemented as the functions of the in-vehicle computer (ECU) 20.

3-1. Map Setting Process

Figure 9:
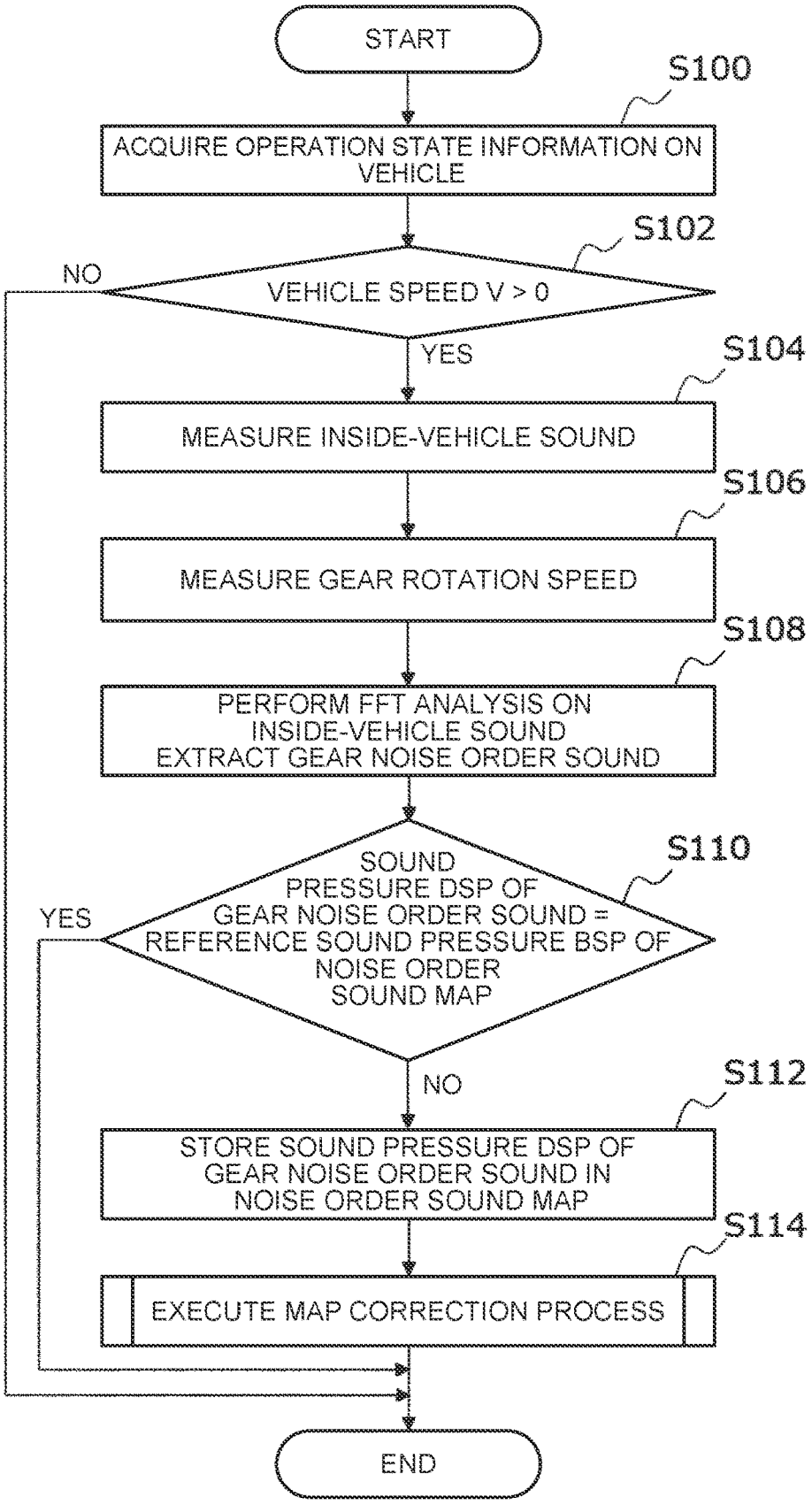
FIG. 9 is a flowchart illustrating a routine to execute a map setting process.

The map setting processing portion 202 executes a setting process of setting the noise order sound map. FIG. 9 is a flowchart illustrating a routine to execute the map setting process. The in-vehicle computer (ECU) 20 executes the routine illustrated in FIG. 9 repeatedly at a predetermined control cycle.

First, in step S100 of the routine illustrated in FIG. 9, operation state information on the vehicle 10 is acquired. Subsequently in step S102, it is determined whether the vehicle speed V calculated based on the operation state information is larger than zero or not. In a case where a negative determination is made, it is determined that the vehicle 10 stops, and this routine is ended. In the meantime, in a case where an affirmative determination is made, the process proceeds to step S104.

In step S104, sounds (vehicle cabin sound) inside the vehicle cabin are measured by use of the microphone 14. The measured vehicle cabin sounds are stored in the memories 20*b*. In subsequent step S106, the rotation speed NEG is measured by use of the rotation speed sensor 18.

In subsequent step S108, FFT analysis is performed on the vehicle cabin sound by use of the number of teeth TN of the gear 12 and the rotation speed NEG, so that a gear noise order sound of the gear 12 is extracted. In the memories 20*b*, the noise order sound map defining the fluctuation characteristics of the reference frequency BFQ and the reference sound pressure BSP of the noise order sound that correspond to fluctuations in the rotation speed NEG is stored. In step S110, it is determined whether or not the sound pressure DSP of the gear noise order sound extracted in step S108 is the same as the reference sound pressure BSP stored in a gear noise map. As a result of the determination, in a case where the sound pressure DSP of the gear noise order sound is equal to the reference sound pressure BSP, this routine is ended, but in a case where the sound pressure DSP of the gear noise order sound is different from the reference sound pressure BSP, the process proceeds to step S112.

In step S112, the sound pressure DSP of the gear noise order sound is stored as a new reference sound pressure BSP for the gear noise map. Hereby, the reference sound pressure BSP of the gear noise map is updated. When the process of step S112 is completed, the process proceeds to step S114. In step S114, the following map correction process is executed.

3-2. Map Correction Process

Figure 10:
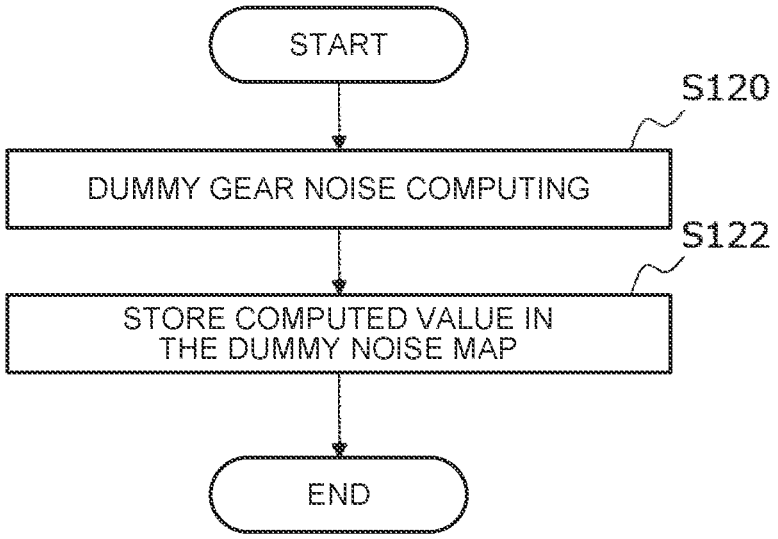
FIG. 10 is a flowchart illustrating a routine to execute a map correction process.

The map correction processing portion 204 executes the map correction process of correcting the dummy noise map. FIG. 10 is a flowchart illustrating a routine to execute the map correction process. In step S114, the in-vehicle computer (ECU) 20 executes a routine illustrated in FIG. 10.

In step S120 of the routine illustrated in FIG. 10, a dummy gear noise is calculated by use of the noise order sound map. Here, the maximum sound pressure MSP is read from the reference sound pressures BSP defined in the noise order sound map. A shortage from the reference sound pressure BSP at each rotation speed NEG to the maximum sound pressure MSP, that is, a sound pressure obtained by subtracting the reference sound pressure BSP from the maximum sound pressure MSP is calculated as a sound pressure for the dummy gear noise. When the process of step S120 is completed, the process proceeds to step S122.

In step S122, the dummy noise map is updated along with the update of the noise order sound map. The dummy gear noise thus calculated is stored in a dummy noise map. Hereby, the dummy noise map is updated. When the process of step S122 is completed, this routine is ended.

3-3. Dummy Noise Output Process

Figure 11:
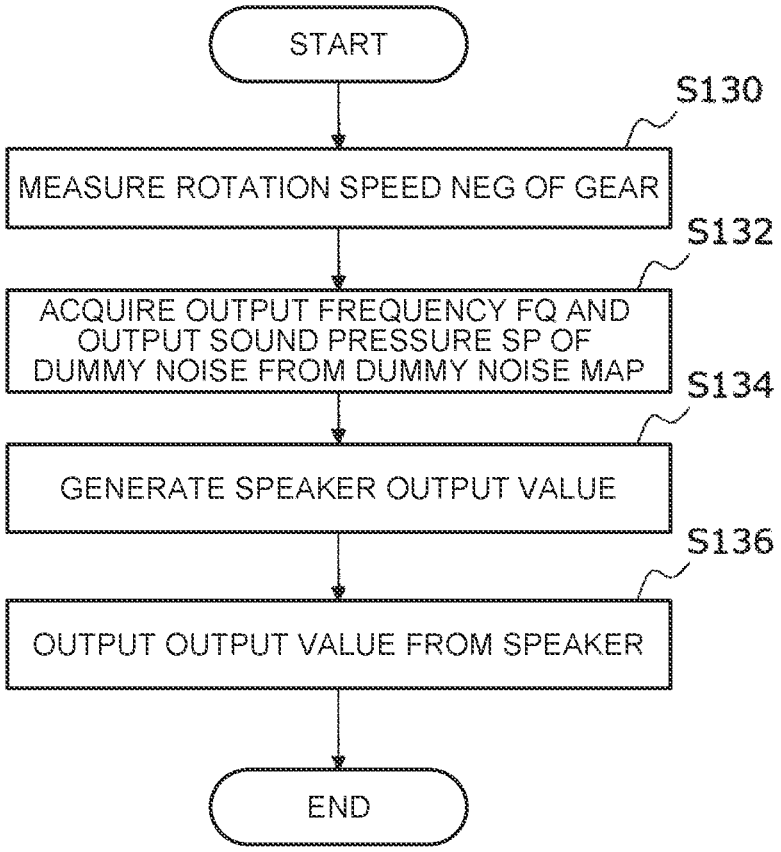
FIG. 11 is a flowchart illustrating a routine to execute a dummy noise output process.

The dummy noise output processing portion 206 executes the dummy noise output process of outputting a dummy noise from the speaker 16. FIG. 11 is a flowchart illustrating a routine to execute the dummy noise output process. The in-vehicle computer (ECU) 20 executes the routine illustrated in FIG. 11 repeatedly at a predetermined control cycle.

In step S130 of the routine illustrated in FIG. 11, first, the rotation speed NEG of the gear 12 of the vehicle 10 is measured by use of the rotation speed sensor 18. In subsequent step S132, the frequency and the sound pressure of the dummy gear noise that correspond to the rotation speed NEG thus measured are acquired by use of the dummy noise map. In subsequent step S134, an output signal to output the acquired dummy gear noise from the speaker 16 is generated. In subsequent step S136, the dummy noise is output from the speaker 16 in accordance with the output signal thus generated.

With the sound production method by the sound production device 100 as described above, even when the rotation speed NEG of the gear 12 fluctuates, the gear noise order sound that an occupant inside the vehicle cabin hears is maintained at a given sound pressure. Hereby, it is possible to reduce an uncomfortable feeling to be given to the occupant by the gear noise order sound.

4. Modifications

The sound production device 100 according to the present embodiment may employ configurations modified as follows.

The present embodiment describes the operation of the sound production device 100 by referring to the gear noise order sound. However, the sound production device 100 of the present embodiment can be applied to various noise order sounds to be generated from rotating bodies such as a motor and an inverter that are provided in the vehicle 10. In this case, the rotation speed correlation value acquisition device should acquire the rotation speed of a target rotating body.

The map setting process is not limited to setting of the reference sound pressure BSP and may also set the reference frequency BFQ based on a measured vehicle cabin sound. In this case, the map setting processing portion 202 determines whether the frequency DFQ of a gear noise order sound extracted from the measured vehicle cabin sound is the same as the reference frequency BFQ stored in the gear noise map or not. In a case where the frequency DFQ is different from the reference frequency BFQ, the frequency DFQ of the gear noise order sound should be stored as a new reference frequency BFQ for the gear noise map.

In the control on the sound production device 100 of the present embodiment, the rotation speed correlation value is not limited to the rotation speed NEG of the gear 12, and the vehicle speed V having a correlation with the rotation speed NEG may be used, for example.

The dummy noise map sets the output sound pressure SP of the dummy noise such that a sum value of the output sound pressure SP of the dummy noise and the reference sound pressure BSP of the gear noise order sound reaches the maximum sound pressure MSP. However, the dummy noise map may set the output sound pressure SP of the dummy noise such that the output sound pressure SP is close to the maximum sound pressure MSP within a range where the sum value does not exceed the maximum sound pressure MSP.

In a case where the sound production device 100 of the present embodiment uses a noise order sound map set by experiment or the like in advance, the map setting process is not a necessary process.

The dummy noise map may consider force FG to be applied to the gear 12 as a parameter to acquire the output sound pressure SP and the output frequency FQ in addition to the rotation speed NEG of the gear 12. The force FG to be applied to the gear 12 can be calculated from torque information on a power source such as a motor or an engine that is included in the operation state information, the radius of the gear 12, or the like. FIG. 12 is a view illustrating an example of a dummy noise map set in consideration of the force to be applied to the gear. In the example illustrated in FIG. 12, the dummy noise map illustrated in FIG. 5 is configured as a three-dimensional map defined for each force FG to be applied to the gear 12.

In the dummy noise output process, the force FG to be applied to the gear 12 is calculated based on operation state information in step S130. Then, in step S132, the output frequency FQ and the output sound pressure SP of the dummy noise that correspond to the rotation speed NEG and the force FG should be acquired from the dummy noise map. With such a process, even in a case where the force FG to be applied to the gear 12 fluctuates, it is possible to maintain the gear noise order sound to be generated inside the vehicle cabin at a given sound pressure.

What is claimed is:

1. A sound production device for producing a dummy noise including a sound with a frequency corresponding to a noise order sound generated from a rotating body provided in a vehicle, the sound production device comprising:

one or more memories in which one or more programs are stored;

one or more processors connected to the one or more memories;

a rotation speed correlation value acquisition device configured to acquire a rotation speed correlation value of the rotating body; and a speaker configured to output sounds inside a vehicle cabin of the vehicle, wherein:

when the one or more processors execute the one or more programs, the one or more processors execute a dummy noise output process of outputting the dummy noise from the speaker in accordance with the rotation speed correlation value;

the noise order sound has a characteristic in which a sound pressure of the noise order sound reaches a maximum sound pressure in a first range of the rotation speed correlation value, and the sound pressure becomes smaller than the maximum sound pressure in second ranges adjacent to both sides the first range; and in the dummy noise output process, when the rotation speed correlation value falls within the first range, the one or more processors do not output the dummy noise, and when the rotation speed correlation value falls within either of the second ranges, the one or more processors output the dummy noise within a range where a sum value of the sound pressure of the noise order sound and an output sound pressure of the dummy noise does not exceed the maximum sound pressure.

2. The sound production device according to claim 1, wherein:

a dummy noise map defining the output sound pressure of the dummy noise in association with a parameter including the rotation speed correlation value is stored in the one or more memories; and in the dummy noise output process, the one or more processors are configured to acquire an output sound pressure for the dummy noise that corresponds to the rotation speed correlation value in accordance with the dummy noise map and to output, from the speaker, the dummy noise with the output sound pressure thus acquired.

3. The sound production device according to claim 2, wherein:

a noise order sound map defining a fluctuation characteristic of the sound pressure of the noise order sound in accordance with fluctuations in the rotation speed correlation value is stored in the one or more memories;

when the one or more processors execute the one or more programs, the one or more processors are configured to execute a map setting process of setting the output sound pressure for the dummy noise defined in the dummy noise map, based on the noise order sound map; and in the map setting process, the one or more processors acquire a sound pressure of the noise order sound from the noise order sound map and set a sound pressure for the dummy noise in the dummy noise map such that a sum value of the acquired sound pressure of the noise order sound and the output sound pressure of the dummy noise reaches the maximum sound pressure.

4. The sound production device according to claim 3, further comprising a microphone configured to collect sounds inside the vehicle cabin of the vehicle, wherein, when the one or more processors execute the one or more programs, the one or more processors further execute a map correction process of correcting the fluctuation characteristic defined in the noise order sound map based on a measured value of the noise order sound measured by use of the microphone.

5. The sound production device according to claim 2, wherein:

the dummy noise map further includes force to be applied to the rotating body as the parameter; and in the dummy noise output process, the one or more processors calculate force to be applied to the rotating body based on operation state information on the vehicle and acquire the output sound pressure for the dummy noise that corresponds to the force to be applied to the rotating body and the rotation speed correlation value, in accordance with the dummy noise map.

6. A sound-production-device equipped vehicle comprising the sound production device according to claim 1.

7. A sound production method for causing a computer to produce, from a speaker, a dummy noise including a sound with a frequency corresponding to a noise order sound generated from a rotating body included in a vehicle, the dummy noise being produced in accordance with a rotation speed correlation value of the rotating body, wherein:

the noise order sound has a characteristic in which a sound pressure of the noise order sound reaches a maximum sound pressure in a first range of the rotation speed correlation value, and the sound pressure becomes smaller than the maximum sound pressure in second ranges adjacent to both sides of the first range;

the computer acquires the rotation speed correlation value of the rotating body; and when the rotation speed correlation value falls within the first range, the computer does not output the dummy noise, and when the rotation speed correlation value falls within either of the second ranges, the computer outputs the dummy noise within a range where a sum value of the sound pressure of the noise order sound and an output sound pressure of the dummy noise does not exceed the maximum sound pressure.

* * * * *